US011332878B2

(12) United States Patent
Kim et al.

(10) Patent No.: US 11,332,878 B2
(45) Date of Patent: May 17, 2022

(54) CLOTHES DRYER AND CONTROL METHOD THEREOF

(71) Applicant: SAMSUNG ELECTRONICS CO., LTD., Suwon-si (KR)

(72) Inventors: Taehun Kim, Suwon-si (KR); Jinyoung Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 111 days.

(21) Appl. No.: 16/830,732

(22) Filed: Mar. 26, 2020

(65) Prior Publication Data

US 2020/0308757 A1 Oct. 1, 2020

(30) Foreign Application Priority Data

Mar. 26, 2019 (KR) ..... 10-2019-0034233

(51) Int. Cl.

| | |
|---|---|
| ***F26B 19/00*** | (2006.01) |
| ***D06F 58/38*** | (2020.01) |
| ***D06F 58/20*** | (2006.01) |
| ***D06F 58/50*** | (2020.01) |
| *D06F 105/58* | (2020.01) |
| *D06F 103/50* | (2020.01) |
| *D06F 105/26* | (2020.01) |
| *D06F 103/32* | (2020.01) |

(52) U.S. Cl.

CPC ..... *D06F 58/38* (2020.02); *D06F 58/206* (2013.01); *D06F 58/50* (2020.02); *D06F 2103/32* (2020.02); *D06F 2103/50* (2020.02); *D06F 2105/26* (2020.02); *D06F 2105/58* (2020.02)

(58) Field of Classification Search

CPC ..... D06F 58/38; D06F 58/206; D06F 58/50; D06F 58/30; D06F 2105/58; D06F 2105/26; D06F 2103/50; D06F 2103/32

USPC ..... 34/90, 524

See application file for complete search history.

(56) References Cited

U.S. PATENT DOCUMENTS

| | | | | |
|---|---|---|---|---|
| 10,982,887 | B2 * | 4/2021 | Inamdar | F25B 39/00 |
| 2012/0079736 | A1 * | 4/2012 | Lee | F25B 49/005 34/476 |
| 2014/0041249 | A1 * | 2/2014 | Jung | D06F 58/206 34/282 |

(Continued)

FOREIGN PATENT DOCUMENTS

| | | | |
|---|---|---|---|
| JP | 5802514 | B2 | 10/2015 |
| KR | 10-1224054 | B1 | 1/2013 |

(Continued)

OTHER PUBLICATIONS

International Search Report dated Jul. 21, 2020, in corresponding International Search Report No. PCT/KR2020/003880.

*Primary Examiner* — John P McCormack

(74) *Attorney, Agent, or Firm* — Staas & Halsey LLP

(57) ABSTRACT

In accordance with one aspect of the disclosure, a clothes dryer includes: a refrigerant pressure sensor provided in at least one of a first pipe connecting an expander to an evaporator or a second pipe connecting the evaporator to a compressor; a refrigerant temperature sensor provided in the second pipe; an electronic expansion valve configured to control a refrigerant; and a controller configured to control the electronic expansion valve based on detection values of the refrigerant pressure sensor and the refrigerant temperature sensor.

16 Claims, 8 Drawing Sheets

(56) References Cited

U.S. PATENT DOCUMENTS

2021/0010195 A1* 1/2021 Brisjo ..... D06F 58/206

FOREIGN PATENT DOCUMENTS

| | | | |
|---|---|---|---|
| KR | 10-1297382 | B1 | 8/2013 |
| KR | 10-2014-0147026 | A | 12/2014 |
| KR | 10-1728404 | B1 | 4/2017 |

* cited by examiner

CLOTHES DRYER AND CONTROL METHOD THEREOF

CROSS-REFERENCE TO RELATED APPLICATION(S)

This application is based on and claims priority under 35 U.S.C. § 119 to Korean Patent Application No. 10-2019-0034233, filed on Mar. 26, 2019 in the Korean Intellectual Property Office, the disclosure of which is incorporated herein by reference.

BACKGROUND

1. Technical Field

The disclosure relates to a clothes dryer including a heat pump system, and a control method thereof.

2. Description of the Related Art

In general, a clothes dryers can be classified into an air vent type, a condenser type, and a heat pump type. The heat pump type clothes dryer may include a heat pump system including a compressor, a condenser, an expander, and an evaporator to heat air, and an air circulation system for supplying the air heated after heat exchange with the condenser to a laundry container.

Refrigerant used in the conventional heat pump system uses a nonflammable refrigerant that does not cause an explosion or fire, but the use of the nonflammable refrigerant is prohibited because it destroys the ozone layer in the atmosphere or accelerates global warming. Therefore, a refrigerant which does not contribute to ozone layer destruction and global warming is used as the refrigerant of the heat pump system, but a flammability problem emerged. Flammable refrigerants may explode or cause fire if a certain amount or more exists in a certain space and the refrigerant temperature is above the ignition temperature.

On the other hand, the prior art related to a heat pump discloses a gas sensor for detecting the leakage of such flammable refrigerant. However, the gas sensor disclosed in the prior art detects the flammable refrigerant from a temperature outside the heat pump system and has a low precision.

In addition, a method of measuring the temperature and pressure of the refrigerant in the prior art is a technique for protecting the compressor before the operation of the heat pump system and is irrelevant to improving the efficiency of the operation of the heat pump.

SUMMARY

Therefore, it is an aspect of the disclosure to provide a clothes dryer for performing accurate measurements of a state of a refrigerant that affects system efficiency during operation and for ensuring the efficiency of performance by specifying a position of a temperature sensor and a pressure sensor provided in a heat pump, and a control method of the clothes dryer.

In addition, it is another aspect of the disclosure to provide a clothes dryer for measuring leakage of a flammable refrigerant and for promoting user safety, and a control method of the clothes dryer.

In accordance with one aspect of the disclosure, a clothes dryer includes: a refrigerant pressure sensor provided in at least one of a first pipe connecting an expander and an evaporator or a second pipe connecting the evaporator and a compressor; a refrigerant temperature sensor provided in the second pipe; an electronic expansion valve configured to control a refrigerant; and a controller configured to control the electronic expansion valve based on detection values of the refrigerant pressure sensor and the refrigerant temperature sensor.

The controller may be configured to calculate a saturation temperature based on the detection value of the refrigerant pressure sensor.

The controller may be configured to compare the calculated saturation temperature and the detection value of the refrigerant temperature sensor and control the electronic expansion valve based on the comparison result.

The controller may be configured to compare the difference between the calculated saturation temperature and the detection value of the refrigerant temperature sensor with a preset reference value, and increase a degree of opening of the electronic expansion valve when the difference between the calculated saturation temperature and the detection value of the refrigerant temperature sensor exceeds the reference value.

The controller may be configured to receive the detection values of the refrigerant pressure sensor and the refrigerant temperature sensor based on a preset period and determine whether to control the electronic expansion valve at each preset period.

The clothes dryer may further include: a temperature sensor configured to detect a temperature of air sucked into the clothes dryer, and the controller may be configured to determine the refrigerant amount based on the detection values of the temperature sensor and the refrigerant pressure sensor.

The controller may be configured to input the detection values of the temperature sensor and the refrigerant pressure sensor into a preset prediction function and calculate the refrigerant amount of a heat pump based on a result of the prediction function.

The controller may be configured to compare the calculated refrigerant amount and a preset reference value.

The controller may be configured to output a warning based on a comparison result of the calculated refrigerant amount and the preset reference value before operation of the heat pump.

In accordance with another aspect of the disclosure, a control method of a clothes dryer, includes: detecting a pressure of a refrigerant through a refrigerant pressure sensor provided in at least one of a first pipe connecting an expander and an evaporator or a second pipe connecting the evaporator and a compressor; detecting a temperature of the refrigerant through a refrigerant temperature sensor provided in the second pipe; and controlling an electronic expansion valve configured to adjust the refrigerant based on the detection values of the refrigerant pressure sensor and the refrigerant temperature sensor.

The controlling may include: calculating a saturation temperature based on the detection value of the refrigerant pressure sensor.

The controlling may include: comparing the calculated saturation temperature and the detection value of the refrigerant temperature sensor and controlling the electronic expansion valve based on the comparison result.

The controlling may include: comparing the calculated saturation temperature and the detection value of the refrigerant temperature sensor; and increasing a degree of opening of the electronic expansion valve when a difference between the calculated saturation temperature and the detection value of the refrigerant temperature sensor exceeds a reference value.

The control method may further include: receiving measured values of the refrigerant pressure sensor and the refrigerant temperature sensor based on a preset period, and determining whether to control the electronic expansion valve.

The control method may further include: detecting a temperature of air sucked into the clothes dryer through a temperature sensor; determining the refrigerant amount based on the detection values of the temperature sensor and the refrigerant pressure sensor.

The determining may include: inputting the detection values of the temperature sensor and the refrigerant pressure sensor into a preset prediction function; and calculating the refrigerant amount of a heat pump based on a result of the prediction function.

The determining may include: comparing the calculated refrigerant amount and a preset reference value.

The control method may further include: determining whether to operate the clothes dryer based on the comparison result.

The determining whether to operate the clothes dryer may include: outputting a warning before the heat pump is operated when the calculated refrigerant amount is less than the preset reference value.

The determining whether to operate the clothes dryer may include: initiating an operation of the heat pump when the calculated refrigerant amount exceeds the preset reference value.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
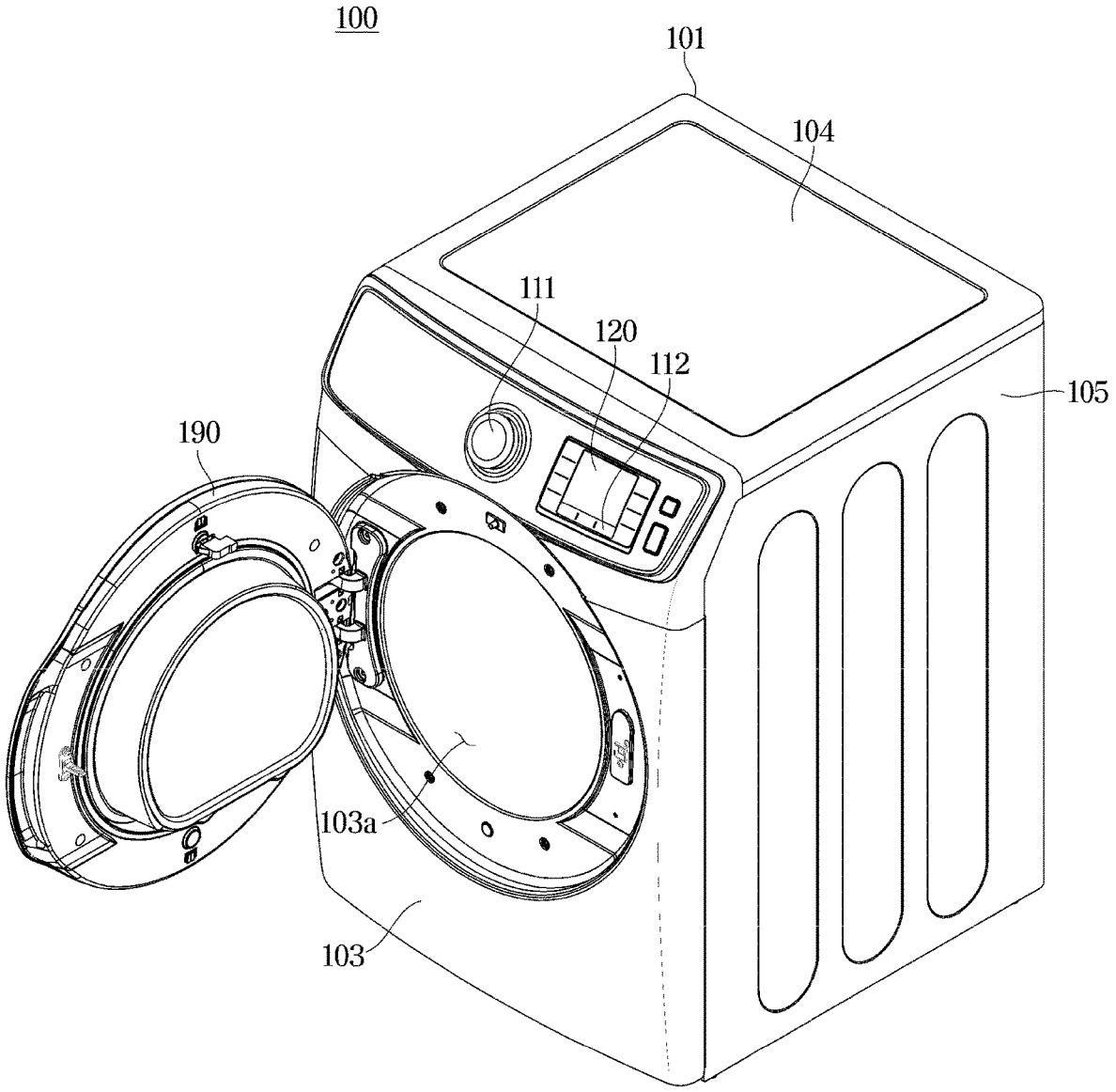
FIG. 1 illustrates an appearance of a clothes dryer according to an embodiment of the disclosure.

Like reference numerals refer to like elements throughout. Not all elements of embodiments are described herein, and general content in the art to which the disclosure pertains or overlapping content between embodiments will be omitted. Terms such as "part," "module," "member," and "block," when used herein, may be implemented by software or hardware. According to embodiments, a plurality of "parts," "modules," "members," or "blocks" may be implemented as a single element, or a single "part," "module," "member," or "block" may include a plurality of elements.

Throughout the specification, when a certain part is described as being "connected" to another part, both a case in which the certain part is indirectly connected to the other part as well as a case in which the certain part is directly connected to the other part are included therein, and the indirect connection includes a connection via a wireless network.

When a certain part is described as "including" a certain element, this signifies that the certain part may also include another element rather than excluding the other element unless particularly described otherwise.

Throughout the specification, when a certain member is described as being "on" another member, both a case in which another member is still present between the two members as well as a case in which the certain member is in contact with the other member are included therein.

Terms such as "first" and "second" are used to distinguish one element from another element, and an element is not limited by the above-mentioned terms.

A singular expression includes a plural expression unless the context clearly indicates otherwise.

Reference numerals for steps are used for convenience of description and are not intended to describe an order of the steps. The steps may be performed in an order different from the stated order unless the context clearly describes a specific order.

Hereinafter, an action principle and embodiments of the disclosure will be described with reference to the accompanying drawings.

Figure 2:
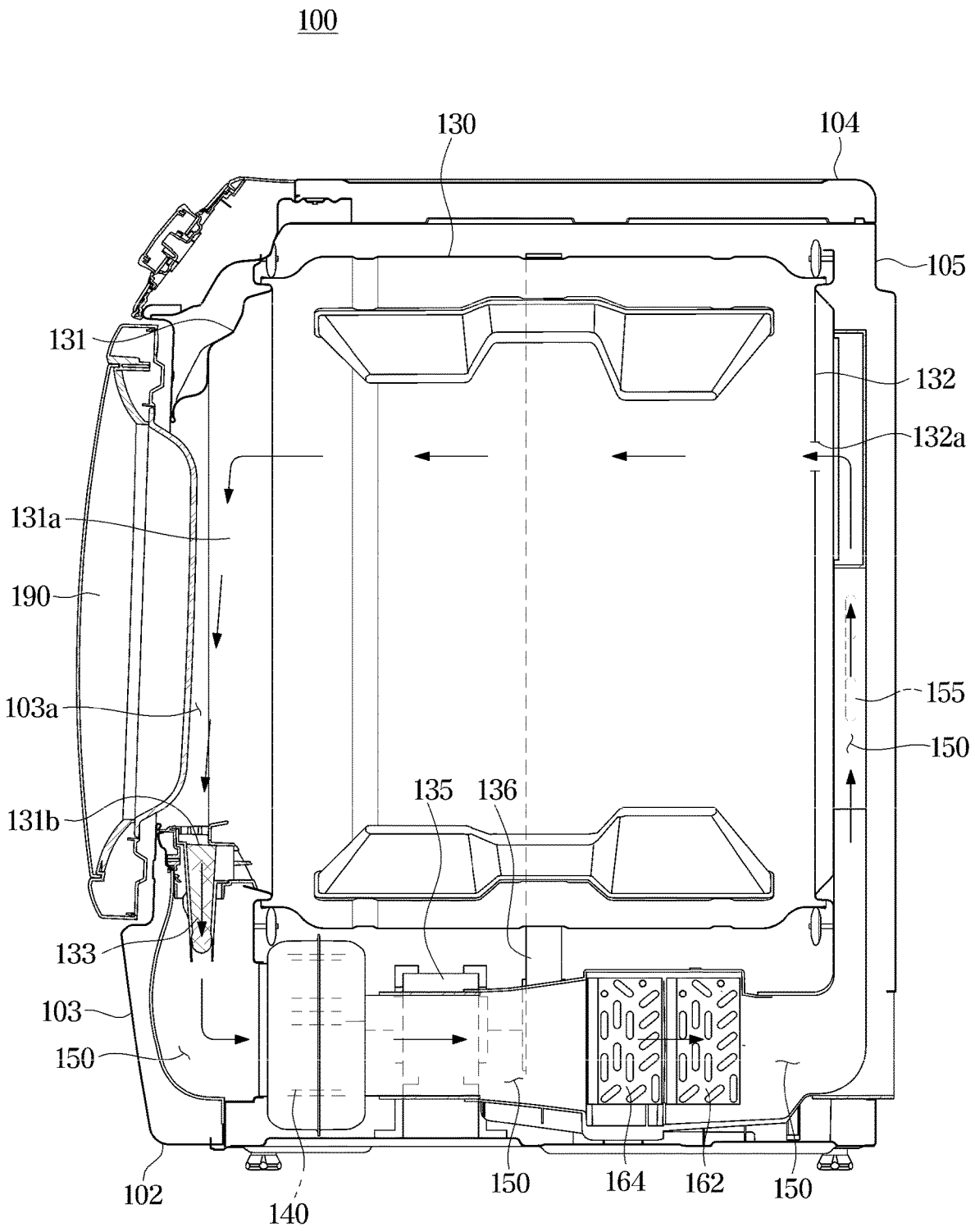
FIG. 2 illustrates a side cross-section of a clothes dryer according to an embodiment of the disclosure.
Figure 3:
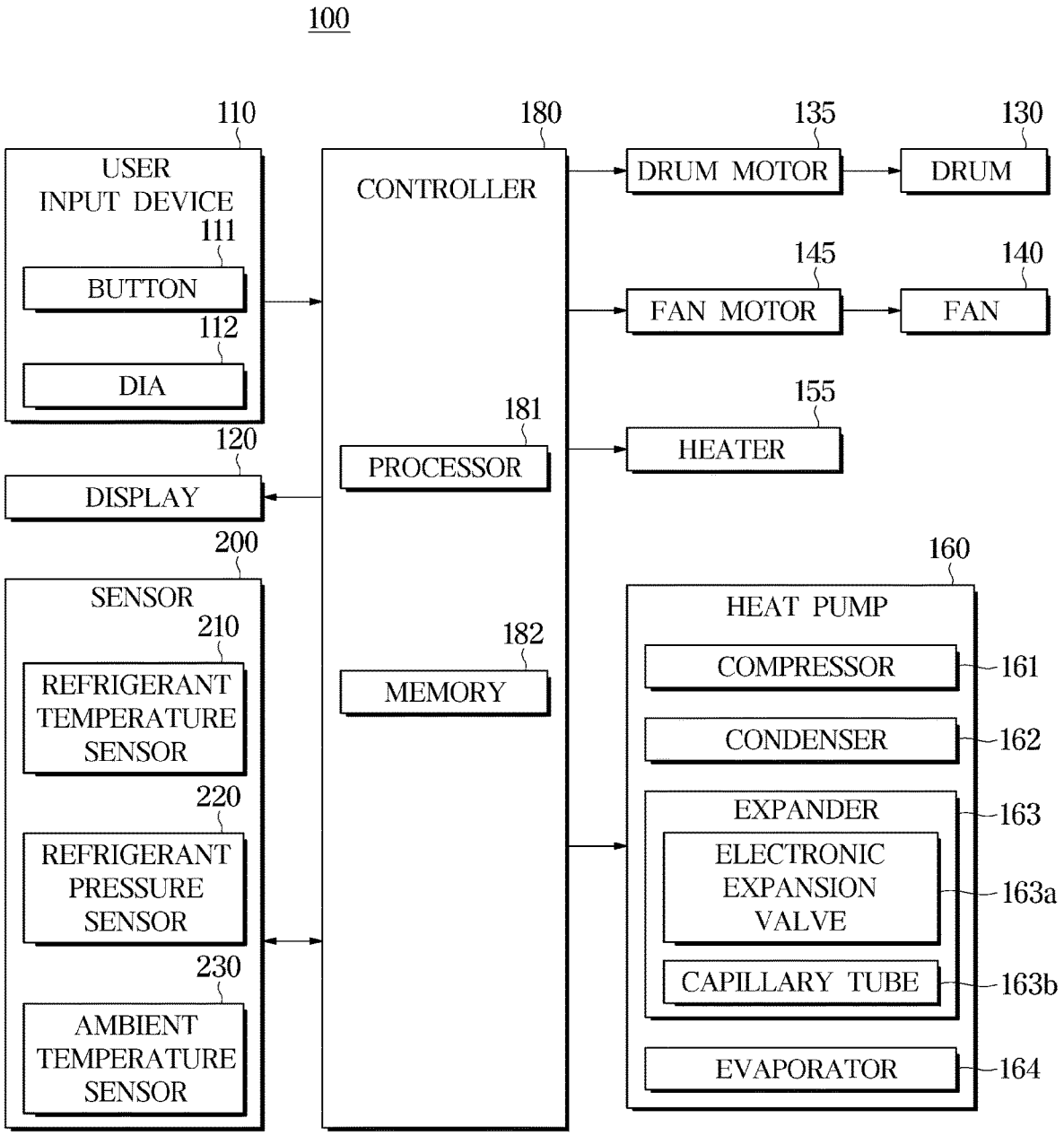
FIG. 3 illustrates a control block diagram of a clothes dryer according to an embodiment of the disclosure.

FIG. 1 illustrates an appearance of a clothes dryer according to an embodiment of the disclosure. FIG. 2 illustrates a side cross-section of a clothes dryer according to an embodiment of the disclosure. FIG. 3 illustrates a control block diagram of a clothes dryer according to an embodiment of the disclosure.

A clothes dryer 100 disclosed refers to an apparatus which rotates a laundry receiving portion accommodating an object to be dried and supplies high-temperature air into the laundry receiving portion to dry the object to be dried. Here, the object to be dried encompasses any object which may be dried by high-temperature air. For example, the object to be dried is not limited and may be any object made of various kinds of fibers and fabrics, such as clothes and towels.

As illustrated in FIGS. 1, 2, and 3, the clothes dryer 100 according to an embodiment includes a rectangular parallelepiped cabinet 101. Also, the clothes dryer 100 includes a user input device 110 provided inside or outside the cabinet 101, a display 120, a drum 130, a drum motor 135, a fan 140, a fan motor 145, a duct 150, a heater 155, a heat pump 160, a sensor 200 and a controller 180 for controlling the above-described configuration.

The cabinet 101 may include a base plate 102, a front cover 103, a top cover 104, and a side-rear cover 105.

The front cover 103 is provided with an opening **103*a*** formed in a substantially circular shape when viewed from the front side.

The opening **103*a* is opened and closed by a door 190 rotatably installed in the cabinet 101**.

When the opening **103*a* is opened by the door 190, a user may inject the object to be dried into the drum 130** or withdraw the dried object.

The user input device 110 and the display 120 for control of the clothes dryer 100 may be disposed at an upper end of the front cover 103.

The user input device 110 may include a dial 112 which is gripped and rotated by the user to input a control command related to an operation of the clothes dryer 100 and a button 111 which is pressed by the user to input a control command related to an operation of the clothes dryer 100.

For example, the clothes dryer 100 may include different drying courses for drying different objects to be dried, and the user may select any one of a plurality of the different drying courses by rotating the dial 112.

Also, the clothes dryer 100 may include a power button for permitting or interrupting power supplied from an external power supply and an operational button for starting or stopping a drying operation of the clothes dryer 100. The button 111 may include a push switch and a membrane switch, each of which is operated by being pressed by the user, or include a touch switch or the like which is operated by being in contact with a part of the user's body.

The user input device 110 may receive a control command through the above-described various hardware devices, convert the received control command into a corresponding electrical signal, and transmit the converted control command to the controller 180.

Meanwhile, the user input device 110 is not limited to including the dial 112 and the button 111 and may include any means that allow the user to input a control command related to an operation of the clothes dryer 100 to the clothes dryer 100. For example, the user input device 110 may also include various known elements such as a remote controller configured to receive a control command from the user at a remote location and transmit the received control command to the clothes dryer 100.

The display 120 may display an operational state of the clothes dryer 100 and a control command from the user. For example, the display 115 may display the drying course selected by the user and display the time remaining until the end of drying during operation of the clothes dryer 100.

In the disclosed embodiment, the display 120 may display information regarding leakage of a flammable refrigerant and output various interfaces for warning the user. For example, the display 120 may display a preset warning message or warning code in text.

The display 120 may be implemented using various types of known displays such as a light emitting diode (LED) panel, an organic light emitting diode (OLED) panel, or a liquid crystal display (LCD) panel. However, the display 120 is not limited thereto and may be any device capable of visually displaying various pieces of information related to the clothes dryer 100.

The display 120 may also employ a touch screen panel (TSP) configured to receive a control command from the user and display operational information corresponding to the received control command. The TSP may include a display configured to display operational information and a control command which may be input by the user, a touch panel configured to detect coordinates of a point with which a part of the user's body has come in contact, and a touch screen controller configured to determine the control command input by the user on the basis of the coordinates of the point of contact detected by the touch panel. The touch screen controller may compare coordinates of the point of touch made by the user detected through the touch panel and coordinates of the control command displayed through the display and recognize the control command input by the user.

The drum 130 accommodates the object to be dried and dries the object to be dried. The drum 130 may be rotatably installed in the cabinet 101.

The drum 130 may be provided in a cylindrical shape whose center of rotation is formed in a front-rear, horizontal direction. A front panel 131 having an opening 131*a* formed therein to allow the object to be dried to be put in the drum 130 may be disposed at a front surface of the drum 130. Also, a rear surface of the drum 130 may be closed by a rear panel 132 having an inlet 132*a* formed therein to allow introduction of high-temperature dry air.

An outlet 131*b* through which air used in drying the object to be dried is discharged may be provided in the front panel 131 of the drum 130. A filter 133 configured to collect foreign substances removed from the object to be dried may be installed in the outlet 131*b*. Accordingly, the foreign substances removed from the object to be dried may be collected by the filter 133.

The drum 130 may receive a rotary force from the drum motor 135 and rotate. The drum 130 is connected to the drum motor 135 disposed in the cabinet 101 by a belt 136. The drum motor 135 may provide the rotary force to the drum 130 through the belt 136.

One or more heat sources may be provided in the clothes dryer 100, and the clothes dryer 100 may supply high-temperature air to the drum 130 through the heat sources. For example, the clothes dryer 100 may include, as the heat sources, the heater 155 and the heat pump 160. In this case, dryers including a heat pump forming a refrigerant circuit may be classified into circulating type dryers and air discharge type dryers according to the flow of air being circulated. The circulating type dryer refers to a dryer capable of drying an object by circulating air without discharging or sucking air. The air discharge type dryer refers to a dryer which sucks outside air, uses the outside air in drying, and then discharges the outside air to the outside of the dryer.

The clothes dryer 100 may include the fan 140 configured to circulate air inside the drum 130. The fan 140 may suck air from inside the drum 130 and discharge the air to the duct 150. By the fan 140, the air inside the drum 130 may circulate through the drum 130 and the duct 150.

The fan 140 may rotate by the fan motor 145. The fan motor 145 may rotate the fan 140 according to a control signal from the controller 180.

The heater 155 and the heat pump 160 may be provided in the duct 150 through which the air inside the drum 130 circulates.

The heat pump 160 includes a compressor 161, a condenser 162, an evaporator 164, and an expander 163. Each of the components of the heat pump 160 may be seated on the base plate 102 at a bottom surface of the cabinet 101.

The compressor 161 may compress a refrigerant in a gaseous state to a high-temperature, high-pressure state and discharge the gaseous refrigerant in the high-temperature, high-pressure state. For example, the compressor 161 may compress the refrigerant through reciprocating movement of a piston or rotation of a rotor. The discharged refrigerant may be transferred to the condenser 162.

The condenser 162 may condense the compressed gaseous refrigerant to a liquid. The condenser 162 may dissipate heat to surrounding portions thereof through the process of condensing the refrigerant. The condenser 162 may be provided in the duct 150 and heat the air through heat generated in the process of condensing the refrigerant. The heated air may be supplied to the drum 130. The liquid refrigerant condensed by the condenser 162 may be transferred to the expander 163.

The expander 163 may expand the high-temperature, high-pressure liquid refrigerant condensed by the condenser 162 to a liquid refrigerant in a low-pressure state. In detail, the expander 163 may include a capillary tube 163*b* for controlling the pressure of the liquid refrigerant and an electronic expansion valve (EEV) 163*a* whose degree of opening may vary according to an electrical signal. The expander 163 controls the performance of the heat pump 160 by adjusting the degree of opening of the electronic expansion valve 163*a* through a control signal of the controller 180.

The evaporator 164 may evaporate the liquid refrigerant expanded by the expander 163. As a result, the evaporator 164 may cause the low-temperature, low-pressure gaseous refrigerant to return to the compressor 161.

The evaporator 164 may absorb heat from surrounding portions thereof through an evaporation process in which the low-pressure liquid refrigerant is changed to a gaseous refrigerant. The evaporator 164 may be provided in the duct 150 and may cool air passing through the evaporator 164 in the evaporation process. Air around the evaporator 164 may be cooled by the evaporator 164, and, when a temperature of the air around the evaporator 164 becomes lower than the dew point, the air around the evaporator 164 may be condensed. Water formed due to condensation at the evaporator 164 may be collected by a water trap provided at a lower portion of the evaporator 164. The water collected by the water trap may move to a separate storage or be drained to the outside of the clothes dryer 100.

Due to the condensation occurring around the evaporator 164, the absolute humidity of air passing through the evaporator 164 may be lowered. In other words, the amount of water vapor contained in the air passing through the evaporator 164 may be reduced. Using the condensation occurring around the evaporator 164, the clothes dryer 100 may reduce the amount of water vapor contained in the air inside the drum 130 and dry the object to be dried.

The evaporator 164 may be disposed more upstream than the condenser 162 on the basis of the flow of air due to the fan 140. The air circulating due to the fan 140 may be dried (water vapor may be condensed) by the evaporator 164 while the air passes through the evaporator 164, and then the air may be heated by the condenser 162 while passing through the condenser 162.

The heater 155 may assist the condenser 162 in heating the air. The heater 155 may heat air in the duct 150 in response to a control signal from the controller 180. For example, before the condenser 162 of the heat pump 160 sufficiently heats the air in the duct 150, the heater 155 may assist the condenser 162 in heating the air in the duct 150.

The temperature inside the drum 130 may rise more rapidly due to the heater 155 assisting the condenser 162, and the clothes dryer 100 may dry the object to be dried more rapidly.

The heater 155 may be disposed more downstream than the condenser 162 on the basis of the flow of air due to the fan 140. The heater 155 may be implemented through a heating coil. However, the heater 155 is not limited thereto and may be implemented through various other known devices.

Meanwhile, the compressor 161, the condenser 162, the expander 163, and the evaporator 164 constituting the heat pump 160 may be connected by pipes 171, 172, 173, and 174 (see FIGS. 4 5) through which the refrigerant flows. The disclosed clothes dryer 100 enables accurate refrigerant state measurement, thereby optimizing the performance and preventing refrigerant leakage by positioning the configuration of the sensor 200, to be described later, in the pipes 171, 172, and 173 set in advance.

The sensor 200 measures various states inside and outside the clothes dryer 100. The sensor 200 may further include a refrigerant temperature sensor 210, a refrigerant pressure sensor 220, an ambient temperature sensor 230, and various other sensors.

In detail, the refrigerant temperature sensor 210 may be provided in the second pipe 172 (see FIGS. 4 and 5) connecting the evaporator 164 and the compressor 161 to measure the temperature of the refrigerant. The refrigerant temperature sensor 210 is installed inside the second pipe 172 to directly measure the temperature of the refrigerant, or installed on an outer surface of the second pipe 172 to indirectly measure the temperature of the refrigerant flowing through the second pipe 172.

On the other hand, the detection value detected by the refrigerant temperature sensor 210 is used to determine the operating performance of the heat pump 160, and is an element to compare with the reference of the performance determination (hereinafter, referred to as first reference value) together with the detection value of the refrigerant pressure sensor 220 to be described later.

The refrigerant pressure sensor 220 may be provided in the first pipe 171 connecting the expander 163 and the evaporator 164 and/or in the second pipe 172. The refrigerant pressure sensor 220 may be inserted through a hole provided in the first pipe 171 or the second pipe 172. The refrigerant pressure sensor 220 measures the pressure of the refrigerant flowing in the pipe (171 or 172).

The ambient temperature sensor 230 may measure the temperature of the ambient air of the clothes dryer 100. The detection value measured by the ambient temperature sensor 230 is an element to compare with a reference (hereinafter, referred to as second reference value) for determining whether the refrigerant is leaked.

Unlike the refrigerant temperature sensor 210 described above, there is no restriction on the location where the ambient temperature sensor 230 is provided, and it is sufficient to be provided anywhere outside or inside the cabinet 101 of the clothes dryer 100.

Detection values of the refrigerant temperature sensor 210, the refrigerant pressure sensor 220, and the ambient temperature sensor 230 are converted into electrical signals and transmitted to the controller 180. The controller 180 adjusts the heat pump 160 based on the measured detection value and detects the leakage of the refrigerant. A detailed description of the operation of the controller 180 will be described later with reference to other drawings.

The sensor 200 may further include various sensors in addition to the refrigerant temperature sensor 210, the refrigerant pressure sensor 220, and the ambient temperature sensor 230.

The controller 180 may include a memory 182 configured to store a program and data for controlling the operation of the clothes dryer 100 and a processor 181 configured to generate a control signal for controlling the operation of the clothes dryer 100 according to the program and data stored in the memory 182.

The memory 182 and the processor 181 may be implemented with separate chips or implemented with a single chip. Also, the controller 180 may include a plurality of memories or a plurality of processors.

In detail, the memory 182 may store a program for operating the heat pump 160 during the operation of the clothes dryer 100. The stored program may include a control method for controlling the electronic expansion valve 163*a* based on the detection value measured by the sensor 200, or for outputting a warning about refrigerant leakage. In addition, the memory 182 may store various reference values required to perform the above-described control method, and may newly store reference values updated by the processor 182.

In addition, the memory 182 may store a program and data for controlling the drying operation according to each of the drying courses. For example, the memory 182 may store a speed of rotation of the drum 130 according to each of the drying courses, a set temperature inside the drum 130 according to each of the drying courses, and the like. Also, the memory 182 may store a user input received through the user input device 110 or store information related to the operation of the clothes dryer 100 (for example, the time remaining until the end of drying) and further include various data not described above.

The memory 182 may include a volatile memory such as static random access memory (S-RAM) and dynamic random access memory (D-RAM) and a non-volatile memory such as read-only memory (ROM), erasable programmable read-only memory (EPROM), and electrically erasable programmable read-only memory (EEPROM).

The memory 182 may include a single memory device or a plurality of memory devices.

The processor 181 may process data according to the program provided from the memory 182 and generate a control signal on the basis of a processing result.

The processor 181 processes the overall operation of the clothes dryer 100 according to the user input received through the user input device 110 and the detection value measured by the sensor 200.

In detail, the processor 181 may generate a control signal for controlling the components included in the clothes dryer 100 such as the drum motor 135, the fan motor 145, the heater 155, and the heat pump 160 according to the user's input command or a preset processing operation program.

For example, the processor 181 may determine whether the refrigerant is leaked before starting the drying operation according to the input of the power button of the user. The processor 181 may detect the external temperature of the clothes dryer 100 and the pressure of the refrigerant in the heat pump 160 through the sensor 200, and determine the degree of the refrigerant leakage. When it is determined that there is a refrigerant leak, the processor 181 may output a warning through the display 120 and speakers (not shown).

When it is determined that the refrigerant is not leaking, the processor 181 may derive an input command regarding the drying course from the user, while outputting the interface indicating that the dryer is operable through the display 120.

Thereafter, the processor 181 may perform the drying operation based on the drying course according to the user input. For example, the processor 181 may determine the rotational speed of the drum 130 according to the drying course, and output a control signal corresponding to the determined rotational speed to the drum motor 135. As another example, the processor 181 may determine a set temperature inside the drum 130 according to the drying course, and output a control signal according to the determined set temperature to the heater 155 and the heat pump 160.

During the above-described drying operation, the processor 181 compares detection values of the refrigerant temperature sensor 210 and the refrigerant pressure sensor 220 provided in the heat pump 160 with the first reference value at a preset period. Here, the first reference value may be stored in advance by a manufacturer in the memory 182 for the optimal operation of the heat pump 160. After determining the current operating state of the heat pump 160, the processor 181 may control the electronic expansion valve 163*a* such that the state of the refrigerant is maintained within a range of the first reference value.

The processor 181 may include an arithmetic circuit, a memory circuit, and a control circuit. The processor 181 may include one chip or may include a plurality of chips. In addition, the processor 181 may include one core or may include a plurality of cores.

In addition to the configuration described in FIG. 3, the clothes dryer 100 disclosed may further include other configurations, and the above-described configuration may be deleted or partially changed as necessary. For example, the deletion of the configuration may omit the heater 155 assisting the role of the condenser 162.

Figure 4:
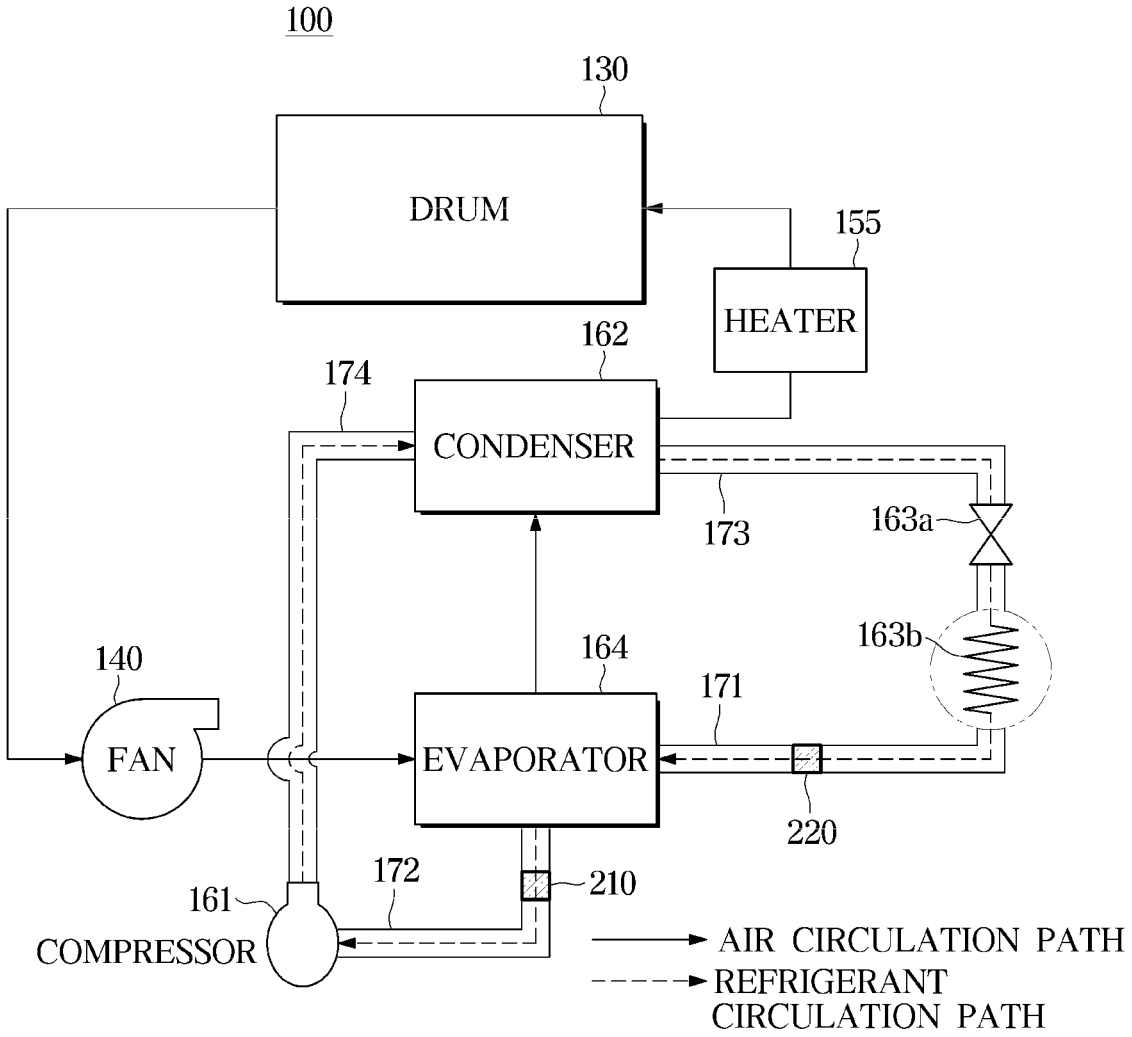
FIGS. 4 and 5 illustrate a position of a sensor according to an embodiment of the disclosure.
Figure 5:
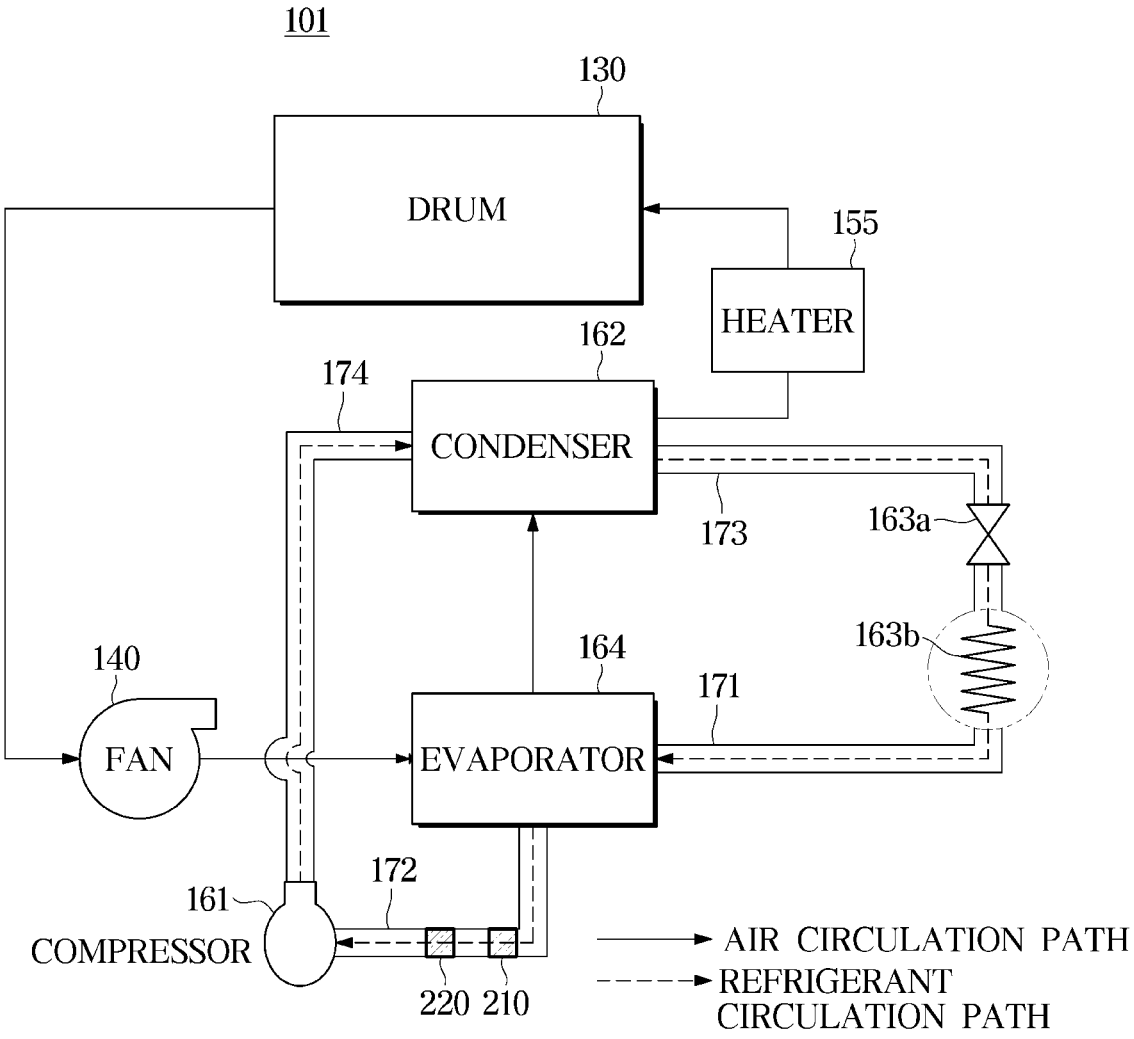
Figure 6:
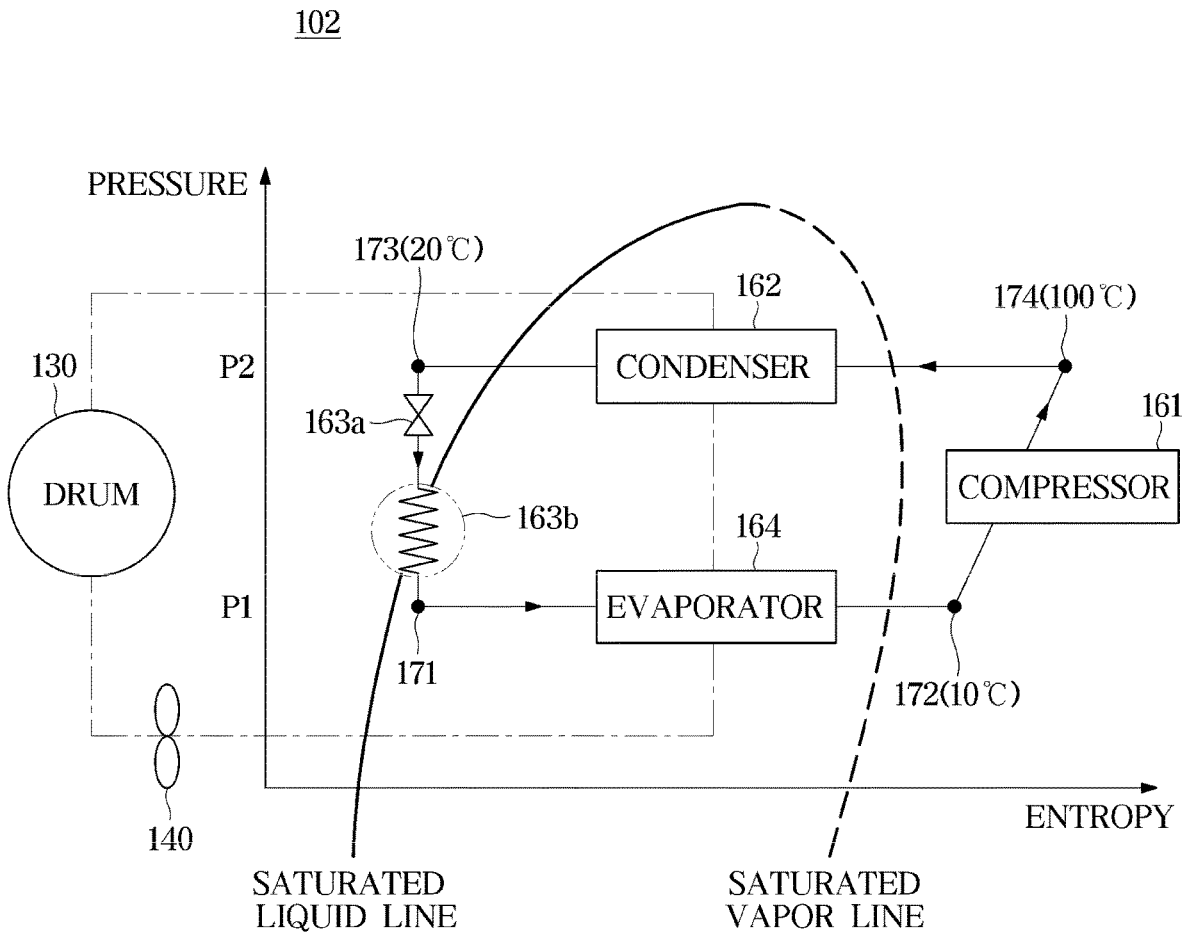
FIG. 6 is a graph illustrating a refrigerant cycle of a clothes dryer.

FIGS. 4 and 5 illustrate a position of a sensor according to an embodiment of the disclosure. FIG. 6 is a graph illustrating a refrigerant cycle of a clothes dryer.

As shown in FIGS. 4, 5 and 6, the disclosed clothes dryers 100 and 101 circulate air in the order of the drum 130, the evaporator 164, the condenser 162 and the heater 155 (solid arrow direction).

In detail, the fan 140 discharges air in the drum 130 to the evaporator 164 provided in the duct 150, and the condenser 162 sucks air into the drum 130. The air cooled and dried by the evaporator 164 is converted into air dried and heated through the condenser 162 and the heater 155. The dried and heated air is discharged back to the drum 130 to dry the object to be dried.

The aforementioned air circulation cycle may be accomplished by a refrigerant cycle 102 of FIG. 6.

Specifically, the gaseous refrigerant is compressed by the compressor 161 to a high temperature (100° C.) and a high pressure (P2). The gaseous refrigerant discharged from the compressor 161 is introduced into the condenser 162 after passing through the fourth pipe 174. The gaseous refrigerant is condensed into liquid by the condenser 162. The condensed refrigerant is introduced into the expander 163 after passing through the third pipe 173. The condensed refrigerant is expanded by the expander 163 into a low pressure P1 liquid refrigerant, and the expanded liquid refrigerant is introduced into the evaporator 164 through the first pipe 171. The expanded liquid refrigerant is changed into a gaseous refrigerant of low temperature (10° C.) and the low pressure P1 by the evaporator 164 and is introduced back into the compressor 161 through the second pipe 172.

The temperature sensor provided in the conventional refrigerant cycle is installed in the fourth pipe 174 which is the discharge port of the compressor 161 to protect the compressor 161 during the operation of the refrigerant cycle 102. However, the temperature of the refrigerant flowing from the fourth pipe 174 to the condenser 162 is very irregular, and there is a problem in that it is insufficient to determine the performance of the system of the entire heat pump 160. Therefore, the measured detection value of the temperature sensor provided in the conventional refrigerant cycle can only be used to determine the performance of the compressor 161. In addition, the third pipe 173 connecting the condenser 162 and the expander 163 is a connection passage before the liquid refrigerant passes through the electronic expansion valve 163*a* which controls the performance of the refrigerant cycle. Therefore, the detection value measured in the third pipe 173 may be a detection value unnecessary for performance control of the refrigerant cycle.

The disclosed clothes dryers 100 and 101 may perform accurate measurement to determine the efficiency of the drying operation, and further determine the leakage of the refrigerant together by accurately specifying the pipes 171 and 172 provided with the refrigerant temperature sensor 210 and the refrigerant pressure sensor 202. Referring back to FIG. 4, the refrigerant pressure sensor 220 may be installed in the first pipe 171. The first pipe 171 is a connection passage through which the expanded liquid refrigerant passing through the capillary tube 163*b* of the expander 163 is introduced into the evaporator 164. In addition, in such an embodiment, the refrigerant temperature sensor 210 may be provided in the second pipe 172. The second pipe 172 is a connection passage through which the low temperature and low pressure gaseous refrigerant changed in the evaporator 164 is introduced into the compressor 161.

Referring to FIG. 5, unlike the clothes dryer of FIG. 4, in the clothes dryer 101 according to another embodiment, the refrigerant temperature sensor 210 and the refrigerant pressure sensor 220 may be installed together in the second pipe 172. In this case, the refrigerant temperature sensor 210 and the refrigerant pressure sensor 220 may be provided in the second pipe 172, and the installation order of each of the sensors is not limited.

On the other hand, in the clothes dryer 100 and 101 disclosed, the location of the configuration (for example, the location of the fan 140) other than the location of the refrigerant temperature sensor 210 and the refrigerant pressure sensor 220 may be changed by those skilled in the art, and the configuration such as the heater 155 may be deleted.

Figure 7:
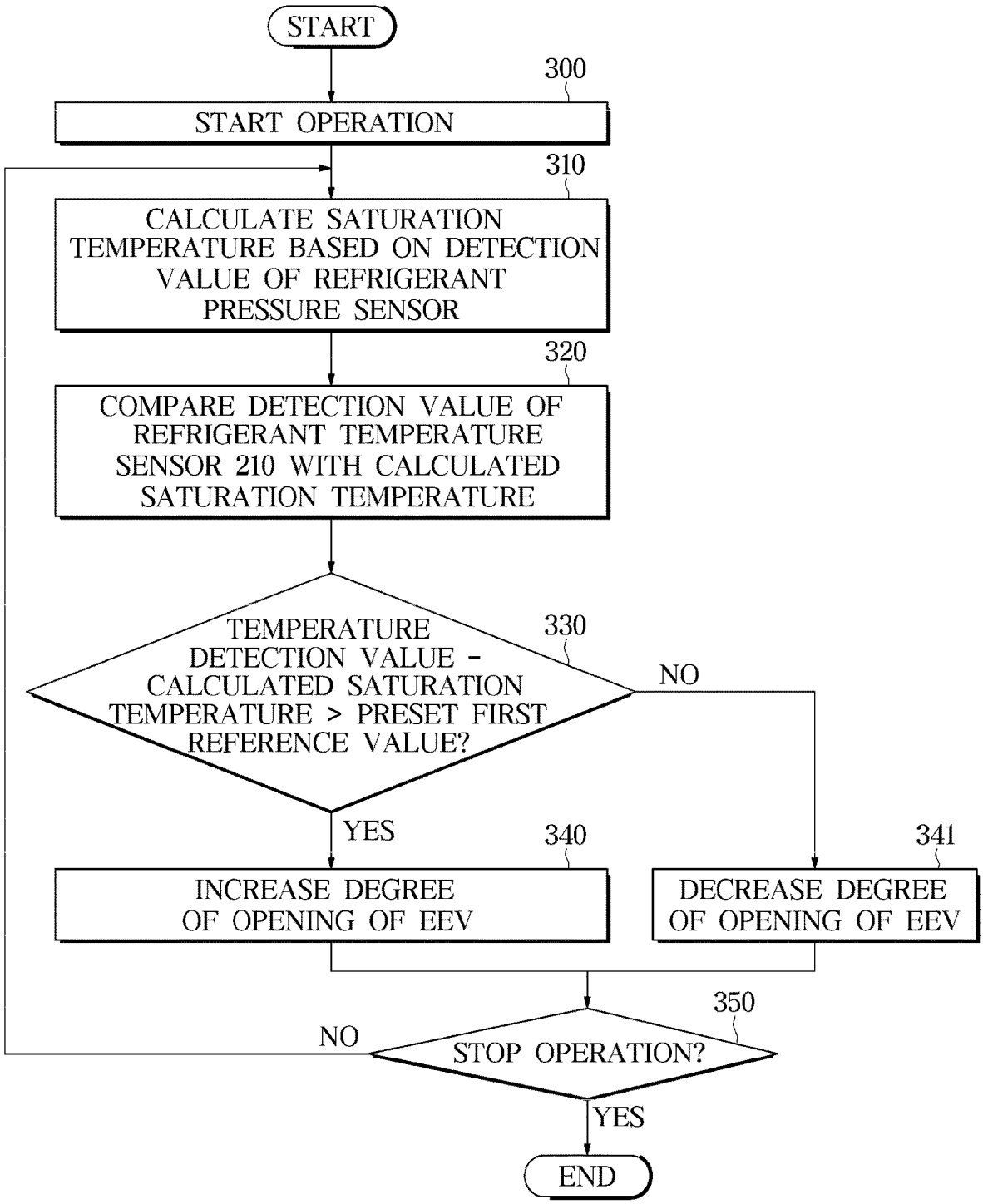
FIG. 7 is a flowchart illustrating a control method of a clothes dryer according to an embodiment of the disclosure.

FIG. 7 is a flowchart illustrating a control method of a clothes dryer according to an embodiment of the disclosure.

As shown in FIG. 7, the controller 180 starts an operation of performing the drying operation (300).

The drying operation may be initiated by the user input. For example, the user enters the drying course through the user input device 110, and the controller 180 may operate the drum motor 135, the fan motor 145, and the heat pump 160 based on the input drying course and a preset temperature inside the drum 30.

The controller 180 calculates a saturation temperature based on the detection value of the refrigerant pressure sensor 220 (310).

Specifically, the refrigerant pressure sensor 220 disclosed may be provided in the first pipe 171 or the second pipe 172. Accordingly, the refrigerant pressure sensor 220 measures the pressure of the expanded liquid refrigerant or the low temperature gaseous refrigerant.

The controller 180 converts the detection value for the pressure detected by the refrigerant pressure sensor 220 to calculate the saturation temperature. The conversion of the detection value of the pressure to the saturation temperature by the controller 180 may be calculated by a conventional general method.

The controller 180 compares the detection value of the refrigerant temperature sensor 210 with the calculated saturation temperature (320).

The refrigerant temperature sensor 210 is provided in the second pipe 172. That is, the controller 180 detects the temperature of the refrigerant discharged from the evaporator 164.

The controller 180 compares the detected refrigerant temperature with the saturation temperature calculated from the refrigerant pressure. When the detected temperature and the saturation temperature match, the performance of the refrigerant cycle is ideal. However, due to the characteristics of the hardware device, the controller 180 stores a limit (the first reference value) that can be experimentally determined to be optimal and then compares the detected temperature with the calculated saturation temperature (330).

In more detail, the first reference value may be 7 degrees, but the first reference value is not limited thereto.

When the difference between the detected temperature and the calculated saturation temperature exceeds the first reference value, the controller 180 increases the degree of opening of the electronic expansion valve 163*a* (340).

When the difference between the detected temperature and the calculated saturation temperature is greater than the first reference value, the controller 180 may determine that the circulation amount of the refrigerant in the heat pump 160 is less than the optimal state. Therefore, the controller 180 increases the degree of opening of the electronic expansion valve 163*a*, thereby increasing the circulation amount of the refrigerant.

When the difference between the detected temperature and the calculated saturation temperature is less than the first reference value, the controller 180 determines that the amount of circulation of the refrigerant is large and decreases the degree of opening of the electronic expansion valve 163*a* (341).

The above-described determination method is continuously performed while the heat pump 160 is operating (NO in 350). That is, the controller 180 terminates according to an operation stop of the heat pump 160 according to the input course and the set time (Yes in 350).

Figure 8:
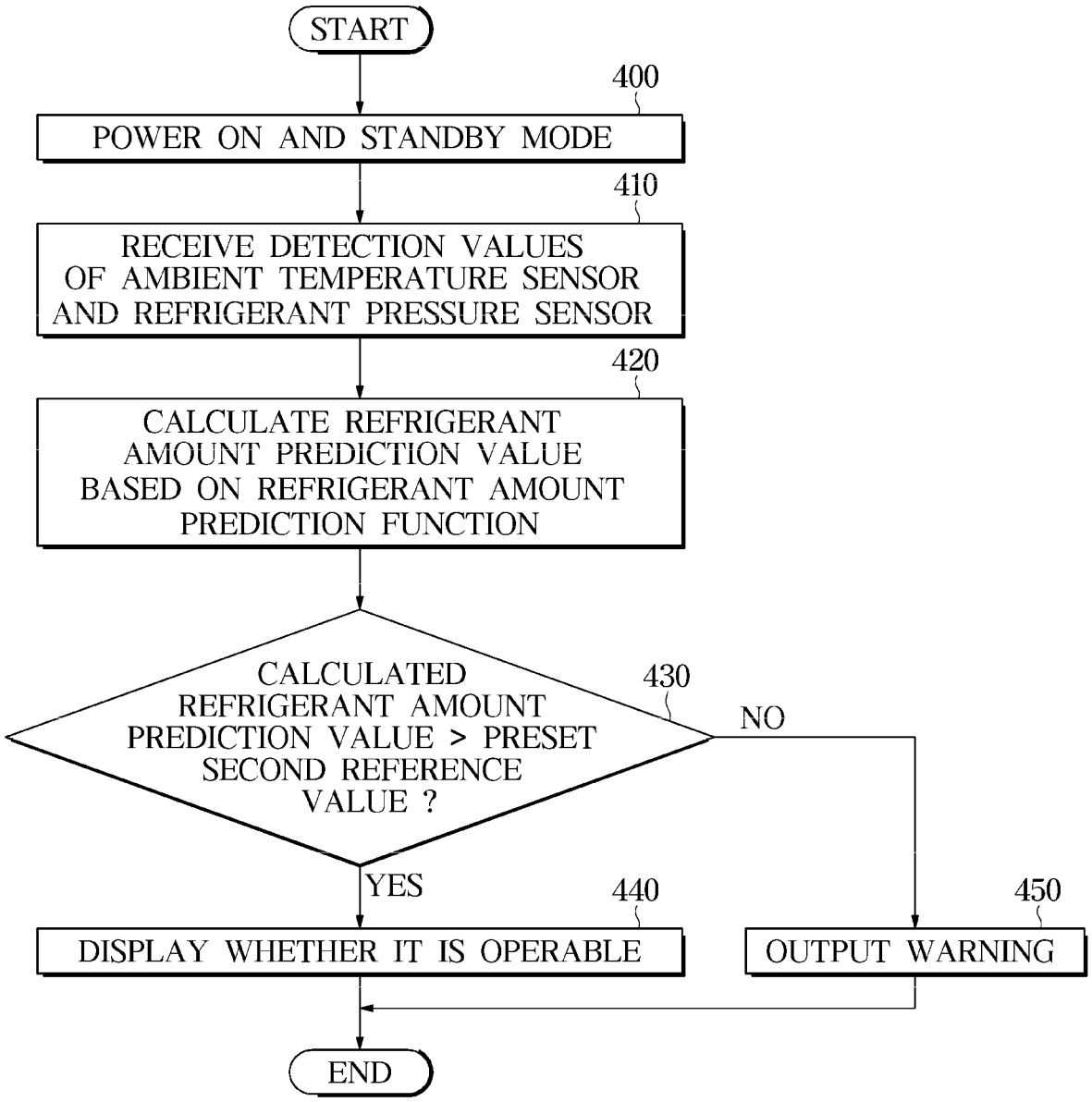
FIG. 8 is a flowchart illustrating a control method of a clothes dryer according to another embodiment of the disclosure.

FIG. 8 is a flowchart illustrating a control method of a clothes dryer according to another embodiment of the disclosure.

As illustrated in FIG. 8, the clothes dryer 100 may be in a standby mode in which power is applied but in which the drying operation is not performed (400).

For example, the user may enter the standby mode through a power button of the user input device 110. The controller 180 does not control the configuration for the drying operation in the standby mode, but waits for the next user's input command.

In the standby mode, the controller 180 receives the detection values of the ambient temperature sensor 230 and the refrigerant pressure sensor 220 (410).

The controller 180 may receive the detection values from the ambient temperature sensor 230 and the refrigerant pressure sensor 220 in the standby mode, and may check the temperature of the air to be sucked and the state of the refrigerant in the refrigerant cycle.

The controller 180 calculates a refrigerant amount prediction value based on a refrigerant amount prediction function (420).

The refrigerant amount prediction function is preset and may be experimentally provided by the manufacturer. The controller 180 inputs the detection value detected by the ambient temperature sensor 230 and the detection value detected by the refrigerant pressure sensor 220 to the refrigerant amount prediction function. The output of the refrigerant amount prediction function is the refrigerant amount prediction value.

The controller 180 compares the calculated refrigerant amount prediction value with a preset second reference value (430).

As described above, the second reference value is a criterion for determining that the flammable refrigerant has leaked in the refrigerant cycle. The second reference value may be stored in advance by the manufacturer and may be changed through the user input device 110 or the like.

When the calculated refrigerant amount prediction value exceeds the preset second reference value, the controller 180 determines that there is no refrigerant leak and displays whether or not it is operable through the display 120 (440).

When the calculated refrigerant amount prediction value is less than the preset second reference value, the controller 180 determines that the refrigerant leaks, and outputs a warning through the display 120 or the speaker (450).

When it is determined that the leakage of the refrigerant occurs, the controller 180 may not perform an operation for safety even if an input command for starting the drying operation by the user is applied.

Through this, the clothes dryer according to an embodiment of the disclosure may perform accurate measurements of the refrigerant status that affects system efficiency during operation, ensure the efficiency of performance by specifying the position of the temperature sensor and the pressure sensor provided in the heat pump, and may prevent a flammable refrigerant from leaking and may promote user safety.

What is claimed is:

1. A clothes dryer comprising:

an evaporator;

a compressor;

an expander;

a first pipe connecting the expander to the evaporator;

a second pipe connecting the evaporator to the compressor;

an air temperature sensor to provide a detection value indicating a temperature of air sucked into the clothes dryer;

a refrigerant pressure sensor in the first pipe to provide a detection value indicating pressure of a refrigerant flowing through the first pipe or in the second pipe to provide a detection value indicating pressure of the refrigerant flowing through the second pipe;

a refrigerant temperature sensor in or on the second pipe to provide a detection value indicating temperature of the refrigerant flowing through the second pipe;

an electronic expansion valve to control the refrigerant; and a controller configured to control the electronic expansion valve based on the detection value provided by the refrigerant pressure sensor and the detection value provided by the refrigerant temperature sensor, wherein the controller is configured to determine an amount of the refrigerant based on the detection value provided by the air temperature sensor and the detection value provided by the refrigerant pressure sensor wherein the controller is configured to calculate a saturation temperature based on the detection value provided by the refrigerant pressure sensor, and control the electronic expansion value in accordance with the calculated saturation temperature.

2. The clothes dryer according to claim 1, wherein the controller is configured to compare the calculated saturation temperature and the detection value provided by the refrigerant temperature sensor, and control the electronic expansion valve based on a comparison result.

3. The clothes dryer according to claim 2, wherein the controller is configured to compare a difference between the calculated saturation temperature and the detection value provided by the refrigerant temperature sensor with a preset reference value, and increase a degree of opening of the electronic expansion valve when the difference exceeds the preset reference value.

4. The clothes dryer according to claim 1, wherein the controller is configured to receive the detection value provided by the refrigerant pressure sensor and the detection value provided by the refrigerant temperature sensor based on a preset period, and determine whether to control the electronic expansion valve at the preset period.

5. The clothes dryer according to claim 1, wherein the controller is configured to input the detection value provided by the air temperature sensor and the detection value provided by the refrigerant pressure sensor into a preset prediction function and calculate an amount of a refrigerant of a heat pump based on a result of the prediction function.

6. The clothes dryer according to claim 5, wherein the controller is configured to compare the calculated amount of the refrigerant with a preset reference value.

7. The clothes dryer according to claim 6, wherein the controller is configured to output a warning based on a result of comparing the calculated amount of the refrigerant with the preset reference value before operation of the heat pump.

8. A control method of a clothes dryer, comprising:

obtaining a detection value indicating pressure of a refrigerant flowing through a first pipe of the clothes dryer connecting an expander of the clothes dryer to an evaporator of the clothes dryer from a refrigerant pressure sensor in the first pipe or a detection value indicating pressure of the refrigerant flowing through a second pipe of the clothes dryer connecting the evaporator to a compressor of the clothes dryer from a refrigerant pressure sensor in the second pipe;

obtaining a detection value indicating temperature of the refrigerant flowing through the second pipe, from a refrigerant temperature sensor in or on the second pipe;

controlling an electronic expansion valve of the clothes dryer to control the refrigerant, based on the obtained detection value indicating pressure of the refrigerant and the obtained detection value indicating temperature of the refrigerant;

obtaining a detection value indicating a temperature of air sucked into the clothes dryer from an air temperature sensor; and determining an amount of the refrigerant based on the obtained detection value indicating the temperature of the air and the obtained detection value indicating the pressure of the refrigerant wherein the controlling comprises: calculating a saturation temperature based on the obtained detection value indicating pressure of the refrigerant.

9. The control method according to claim 8, wherein the controlling comprises:

comparing the calculated saturation temperature with the obtained detection value indicating temperature of the refrigerant and controlling the electronic expansion valve based on a comparison result.

10. The control method according to claim 9, wherein the controlling comprises:

comparing the calculated saturation temperature with the obtained detection value indicating temperature of the refrigerant; and increasing a degree of opening of the electronic expansion valve when a difference between the calculated saturation temperature and the obtained detection value indicating temperature of the refrigerant exceeds a reference value.

11. The control method according to claim 10, wherein the detection value indicating pressure of the refrigerant and the detection value indicating temperature of the refrigerant are obtained based on a preset period.

12. The control method according to claim 8, wherein the determining comprises:

inputting the obtained detection value indicating the temperature of the air and the obtained detection value indicating the pressure of the refrigerant into a preset prediction function; and calculating an amount of a refrigerant of a heat pump based on a result of the prediction function.

13. The control method according to claim 12, wherein the determining comprises:

comparing the calculated amount of the refrigerant with a preset reference value.

14. The control method according to claim 13, further comprising:

determining whether to operate the clothes dryer based on a comparison result of the comparing.

15. The control method according to claim 14, wherein the determining whether to operate the clothes dryer comprises:

outputting a warning before the heat pump is operated when the calculated amount of the refrigerant is less than the preset reference value.

16. The control method according to claim 14, wherein the determining whether to operate the clothes dryer comprises:

initiating an operation of the heat pump when the calculated amount of the refrigerant exceeds the preset reference value.

* * * * *